US006530532B1

(12) United States Patent
Santiesteban et al.

(10) Patent No.: US 6,530,532 B1
(45) Date of Patent: Mar. 11, 2003

(54) KICK-STARTER FOR SPRINKLER HEADS

(75) Inventors: Theodore G. Santiesteban, Orlando, FL (US); Davis T. Bradberry, Clermont, FL (US)

(73) Assignee: Senninger Irrigation, Inc., Orlando, FL (US)

( * ) Notice: Subject to any disclaimer, the term of this patent is extended or adjusted under 35 U.S.C. 154(b) by 0 days.

(21) Appl. No.: 09/777,174

(22) Filed: Feb. 5, 2001

Related U.S. Application Data

(60) Provisional application No. 60/180,495, filed on Feb. 5, 2000.

(51) Int. Cl.[7] ..... B05B 3/08

(52) U.S. Cl. ..... 239/233; 239/222.15; 239/223

(58) Field of Search ..... 239/233, 222.13, 239/222.15, 222.17, 222.19, 222.21, 223, 224

(56) References Cited

U.S. PATENT DOCUMENTS

| | | | | |
|---|---|---|---|---|
| 1,950,712 A | | 3/1934 | Coles et al. | |
| 2,108,787 A | | 2/1938 | Coles et al. | |
| 2,273,401 A | | 2/1942 | Ferrando et al. | |
| 2,473,945 A | | 6/1949 | Gibson | |
| 3,009,648 A | | 11/1961 | Hait | |
| 3,034,728 A | | 5/1962 | Hruby, Jr. | |
| 3,468,485 A | | 9/1969 | Sully | |
| 3,651,903 A | | 3/1972 | Butler et al. | |
| 3,861,503 A | | 1/1975 | Nash | |
| 3,865,216 A | | 2/1975 | Gryglas | |
| 4,073,438 A | * | 2/1978 | Meyer | 239/237 |
| D259,438 S | | 6/1981 | Meyer | |
| 4,356,972 A | | 11/1982 | Vikre | |
| 4,440,345 A | | 4/1984 | Figwer et al. | |
| 4,487,368 A | | 12/1984 | Clearman | |
| 4,492,339 A | | 1/1985 | Kreitzberg | |
| 4,498,628 A | | 2/1985 | Tucker | |
| 4,527,675 A | | 7/1985 | Omata et al. | |
| 4,560,108 A | | 12/1985 | Rubinstein | |
| 4,565,266 A | | 1/1986 | Omata | |
| 4,660,766 A | | 4/1987 | Nelson et al. | |
| 4,773,594 A | | 9/1988 | Clearman | |
| 4,805,838 A | * | 2/1989 | Greenberg | 239/222.17 |
| 5,297,737 A | * | 3/1994 | Davisson | 239/222.17 |
| 5,377,914 A | | 1/1995 | Christen | |
| 5,950,927 A | | 9/1999 | Elliot et al. | |
| 5,971,297 A | * | 10/1999 | Sesser | 239/222.21 |

FOREIGN PATENT DOCUMENTS

| | | |
|---|---|---|
| DE | 403351 | 1/1923 |
| FR | 1321580 | 2/1963 |

* cited by examiner

*Primary Examiner*—Michael Mar
*Assistant Examiner*—Dinh Q. Nguyen
(74) *Attorney, Agent, or Firm*—Saliwanchik, Lloyd & Saliwanchik

(57) ABSTRACT

The subject invention is a Kick-Starter (KS) which can be readily adapted to a variety of sprinkler head designs to increase start up efficiency, as well as efficiency and uniformity of water distribution during operation of the sprinkler head. The Kick-Starter is incorporated into a sprinkler head comprising a sprinkler body with a water inlet disposed therein, a nozzle orifice in fluid connection with said water inlet, and a water deflecting pad movably attached to said sprinkler body. The Kick-Starter mechanism comprises a KS pass-through hole and a KS deflector in fluid connection with said pass-through hole. The Kick-Starter mechanism is connected to the water deflecting pad in a configuration such that a water jet exiting the nozzle orifice will encounter the KS pass-through hole and contact the KS deflector, whereby the water is redirected at an angle causing a propulsive force that drives said water deflecting pad from its resting position and into increasing engagement with the water jet, and motion of the sprinkler head is thereby initiated. As the water deflecting pad is increasingly engaged by the water jet, the KS pass-through hole is progressively disengaged from the water jet. The Kick-Starter mechanism of the subject invention can be used in connection with a variety of sprinkler head designs, including wobbler type and spinner type sprinkler heads.

22 Claims, 4 Drawing Sheets

KICK-STARTER FOR SPRINKLER HEADS

CROSS-REFERENCE TO A RELATED APPLICATION

This application claims the benefit of U.S. Provisional Application No. 60/180,495, filed Feb. 5, 2000.

BACKGROUND OF THE INVENTION

The present invention relates to sprinkler heads.

There have been many attempts to provide improved sprinkler heads for irrigation purposes, both commercial and private, large and small-scale. In most systems, the goal is to provide uniform distribution over the largest effective area. Depending on the system design, sprinkler heads can be hung below an elevated water source, as is common in many commercial systems for example where a plurality of water sprinkling heads are hung beneath a water conduit arm which gradually passes over large sections of the area to be irrigated; or they can be mounted above a water source, as is common in a variety of home sprinkler system designs. A factor to be considered in the design of any sprinkler head is the ability to initiate and maintain efficient continuous motion. Stalling sprinkler head motion, either upon start-up or interrupting operation, results in uneven, inefficient, and therefore undesired water distribution. Examples of the variety of sprinkler head designs which have addressed these concerns may be found in U.S. Pat. No. 3,009,648 issued to Hait; U.S. Pat. No. 3,034,728 issued to Hruby, Jr.; U.S. Pat. No. 4,356,972 issued to Vikre; U.S. Pat. Nos. 4,487,368 and 4,773,594, both issued to Clearman; and U.S. Pat. Nos. 5,381,960 and 5,950,927 issued to Elliott and McFadden. Despite all previous attempts, there still exists a need for improvements in sprinkler head design which reduce the incidence of stalling and which increase the uniformity and surface area of coverage provided by a given stream of water. It is an object of the present invention to provide reliable sprinkler head start-up without stalling upon application of water pressure. It is another object of the present invention to allow for a wider range of nozzle diameter, and thus a larger range of water flow rates for efficient irrigation with a given sprinkler head design. It is yet another object of the invention to provide a sprinkler head with a main water deflector pad which is self-cleaning of debris. Still another object of the invention is to provide a starter mechanism which, after initial start up of the sprinkler, becomes partially or completely disengaged from the water jet.

BRIEF SUMMARY OF THE INVENTION

The subject invention is a Kick-Starter (KS) which can be readily adapted to a variety of sprinkler head designs to increase start up efficiency, as well as efficiency and uniformity of water distribution during operation of the sprinkler head. The Kick-Starter is incorporated into a sprinkler head comprising a sprinkler body with a water inlet disposed therein, a nozzle orifice in fluid connection with said water inlet, and a water deflecting pad movably attached to said sprinkler body. The Kick-Starter mechanism comprises a KS pass-through hole and a KS deflector in fluid connection with said pass-through hole. The Kick-Starter mechanism is connected to the water deflecting pad in a configuration such that a water jet exiting the nozzle orifice will encounter the KS pass-through hole and contact the KS deflector, whereby the water is redirected at an angle causing a propulsive force that drives said water deflecting pad from its resting position and into increasing engagement with the water jet, and motion of the sprinkler head is thereby initiated. As the water deflecting pad is increasingly engaged by the water jet, the KS pass-through hole is progressively disengaged from the water jet. The Kick-Starter mechanism of the subject invention can be used in connection with a variety of sprinkler head designs, including wobbler type and spinner type sprinkler heads.

In a preferred embodiment, and as specifically exemplified herein, the Kick-Starter is used in connection with a wobbling sprinkler head, which is operable whether facing downward from a water supply conduit or facing upward and mounted above a water supply conduit. The sprinkler head as exemplified herein has a body having a water inlet as well as an attachment for connection to the water supply, and a nozzle for directing a stream of water from the sprinkler body. The wobbler of the sprinkler head used herein for illustration purposes is a main deflector head movably attached to a sprinkler body, the deflector head having a main water deflecting pad or surface positioned to deflect water directed thereagainst from the nozzle. The water deflecting pad has a plurality of main deflector grooves which cause the main deflector head to move responsive to the water being directed there against, and which serve in part to direct the deflected water away from the deflector head. The Kick-Starter is positioned substantially central to the main deflector, and comprises a KS pass-through hole substantially centered in the main deflector's water deflecting pad, a KS deflector, and a KS shaft, which serves to connect the KS deflector to the back side of the main deflector behind the water deflecting surface. The configuration of this embodiment of the KS shaft and KS deflector is such that as attached to the reverse side of the main deflector, the KS shaft and KS deflector define a KS exit orifice. The Kick-Starter must be configured such that in its resting position, with the water supply off, the KS pass-through hole is substantially aligned with the nozzle orifice. When a sprinkler head having the Kick-Starter is attached to a water supply, and the water turned on, water flows into the sprinkler body through the nozzle and out the nozzle orifice, where it is directed in the general direction of the main deflector. Water will then enter the KS pass-through hole, thereby traveling through the main deflector where it contacts the KS deflector and is thereby deflected out of the KS exit orifice. The KS deflector thus directs the water away at an angle, causing a propulsive force driving the main deflector head from its resting position. As the main deflector head tilts from its resting position, the water deflecting pad of the main deflector is increasingly engaged by the jet of water flowing through the nozzle until the rotational propulsive force becomes large enough to drive the main deflector into its operating motion. Once the main deflector is at its maximum engagement with the water jet exiting the nozzle, the Kick-Starter becomes disengaged or partially disengaged from the jet of water. When the water supply is cut off, the Kick-Starter returns to its original resting position.

Because of the Kick-Starter, a larger range of nozzles can be utilized. It allows for smaller nozzles by increasing and concentrating the starting force (the angle and shape of the KS deflector can be varied as desired depending on sprinkler size and configuration). On the other end of the spectrum, the Kick-Starter allows for larger nozzles by decreasing the perpendicular/near perpendicular resultant forces to the nozzle flange (the size and path of the KS pass-through hole is dependent on the sprinkler size and configuration). The KS skirted area also allows for precise matching/metering of nozzle and starting force (the shape of the KS skirt can be varied depending on sprinkler size and configuration).

The Kick-Starter results in an increase in both the Coefficient of Uniformity and the Distribution Uniformity. This is a result of the Kick-Starter acting as an additional groove trajectory beyond the range of the main deflector grooves (large nozzles). It also allows the main deflector pad grooves to have less offset and therefore throw further than in prior art designs.

DETAILED DISCLOSURE OF THE INVENTION

In a preferred embodiment, exemplified by a wobbler type sprinkler head, the Kick-Starter resides in the center area of the main deflector. In this embodiment, the Kick-Starter has three main elements: 1) the KS pass-through hole; 2) the KS shaft and skirt area; and 3) the KS deflector. The Kick-Starter mechanism starts the motion of the sprinkler in both inverted and upright orientations. This is accomplished by initially channeling the nozzle orifice water jet (either completely or partially) past the main water deflecting pad surface, through the KS pass-through hole (the size and path of the KS pass through hole can be varied depending on the sprinkler size and configuration), to the KS deflector. The KS deflector directs the water at a given angle (the angle and shape of the KS deflector can be varied depending on sprinkler size and configuration), causing a propulsive force driving the main deflector head, in a preferred embodiment, a water deflector/tripod assembly (the tripod assembly consists of the main deflector and tripod, which are affixed to one another and move, in unison), from rest. As the main deflector tilts from its resting position, the main water deflecting pad is increasingly engaged by the jet of water until the rotational propulsive force becomes large enough to drive the main deflector into the wobbling/spinning action. In this embodiment, the size and shape of the KS skirt controls the rate of this tilt (during which the Kick-Starter becomes progressively disengaged from the water jet) by affecting the size of the KS exit orifice. The shape of the KS skirt can be varied as desired depending on sprinkler size and configuration. Once the main deflector is at its maximum engagement with the water jet the KS has become disengaged or partially disengaged from that jet of water. This disengagement of the Kick-Starter after the initial startup is yet another aspect that separates this invention from designs of the prior art.

Figure 1:
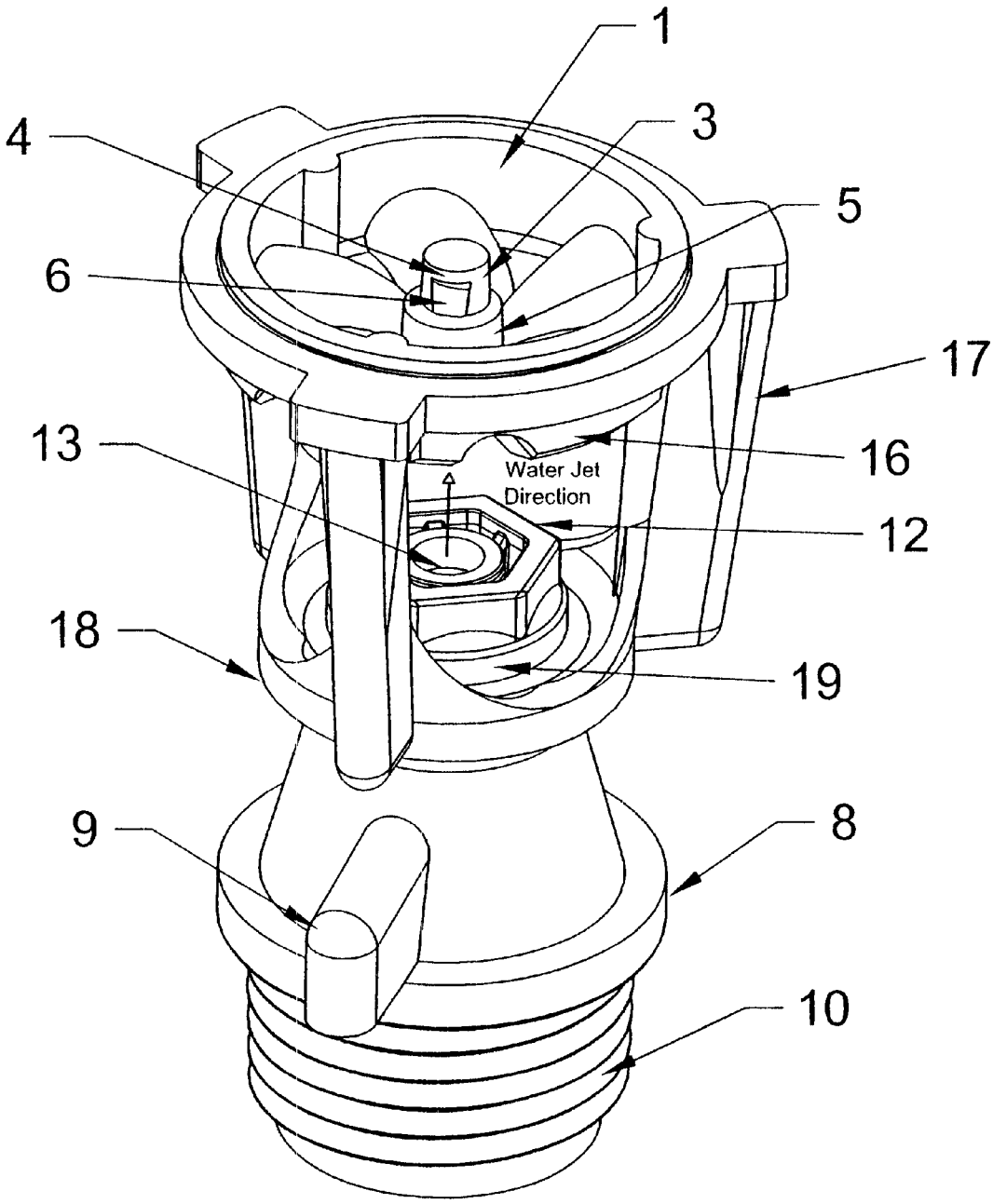
FIG. 1 is a perspective view of a sprinkler head, wobbler type, which comprises a preferred embodiment of the Kick-Starter of the subject invention, providing a view of the Kick-Starter deflector pad and exit orifice.
Figure 2:
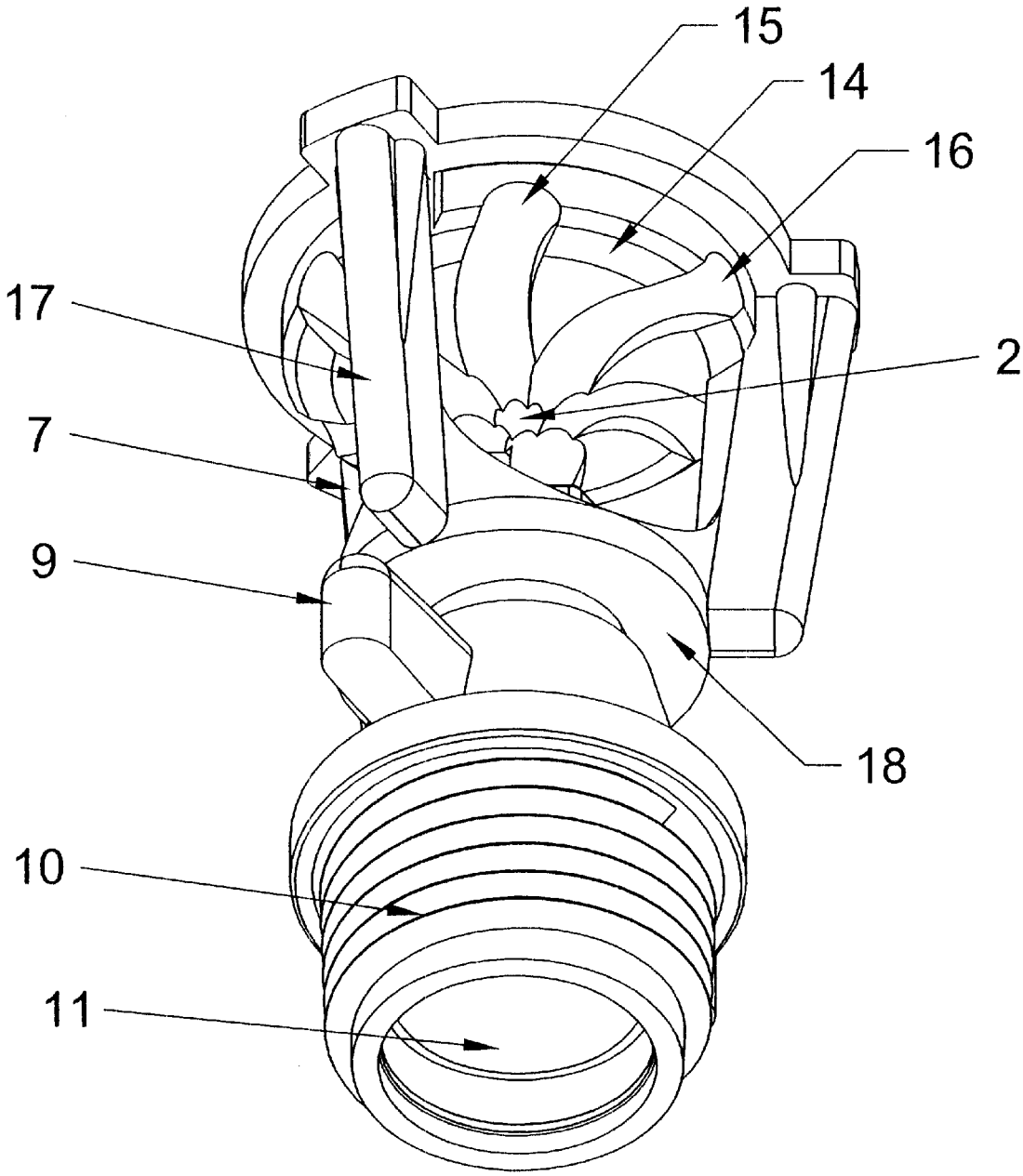
FIG. 2 is another perspective view (reverse) of the sprinkler head of FIG. 1, wherein the pass-through hole of the subject invention is visible.
Figure 4:
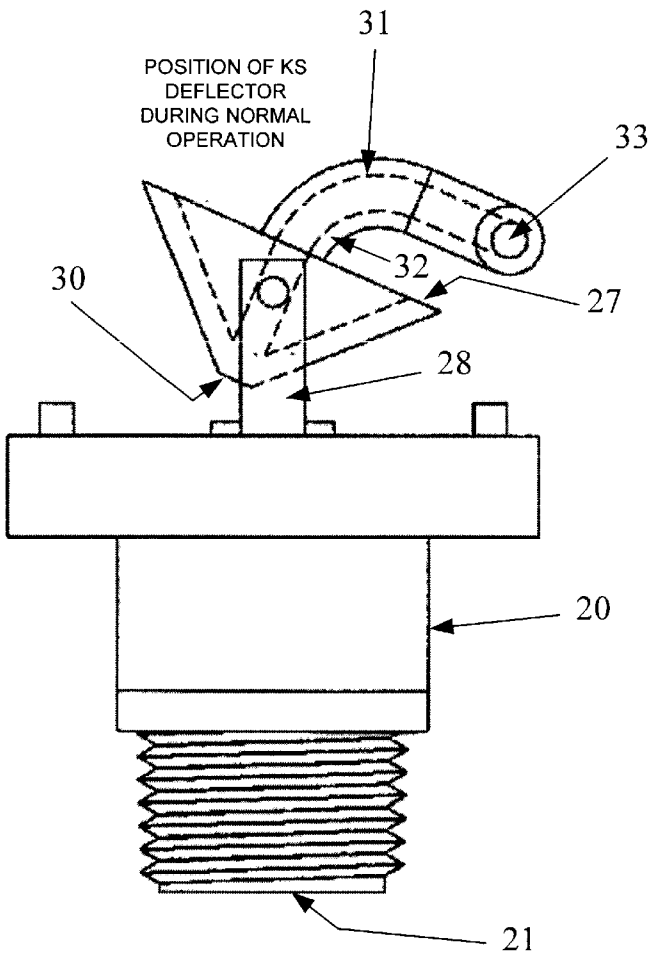
FIG. 4 is a side view of the sprinkler of FIG. 3, depicting the position of the Kick-Starter and main deflector head in its normal operational position.
Figure 3:
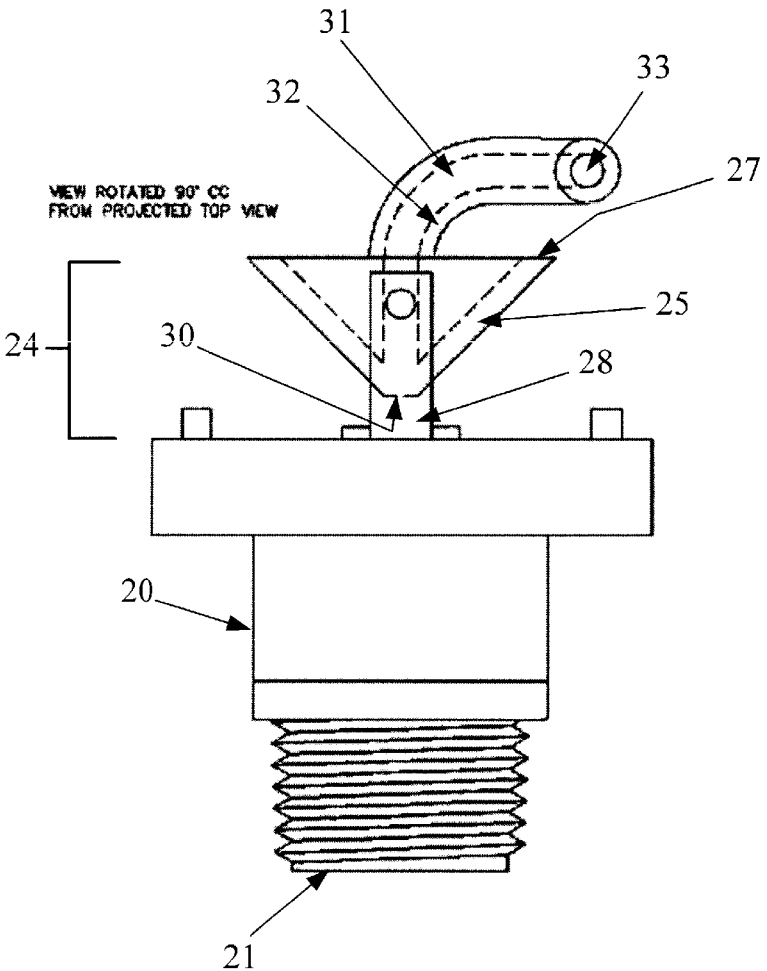
FIG. 3 is a side view of a sprinkler head, spinner type, which comprises another preferred embodiment of the Kick-Starter of the subject invention, depicting the Kick-Starter in its resting position.

Referring to FIG. 1, which depicts a wobbler sprinkler head design modified to comprise the Kick-Starter of the subject invention, a sprinkler head 9, as seen in FIGS. 1 and 2, includes a threaded base 10 forming part of the sprinkler body 8. Sprinkler body 8 has a water inlet 11 at one end and a nozzle 12 at the other. A nozzle orifice 13 is disposed within nozzle 12, and is in fluid connection with water inlet 11. Sprinkler body 8 has an attached main deflector head 1 having a water deflecting pad 14 attached thereto. The deflecting pad 14 has a plurality of deflector grooves 15 formed therein for deflecting water being directed thereagainst, with each of the grooves 15 on deflection pad 14 open along the peripheral edge portions 16 of deflection pad 14. The deflection pad 14 is held by a plurality of posts 17. In this embodiment, three posts have been used which are in turn all attached to a post support base portion 18. The post base portion 18 is preferably shaped generally like a washer and has an opening in the center thereof. Posts 17 and base portion 18, in this configuration, form tripod 7.

Nozzle 12 has a generally circumferential nozzle flange 19 which is configured and dimensioned so as to prevent main deflector head 1 from separating from sprinkler body 8, yet allows main deflector head 1 to rotate and pivot in a loose manner such that when water exiting water orifice 13 impacts water deflection pad 14, it allows main deflector head 1 to deflect, rotate, and freely wobble.

Water deflecting pad 14 has a KS pass-through hole 2 disposed generally centrally therein. A KS deflector 4 is affixed to the backside of main deflector head 1 behind water deflecting pad 14 in a position so as to encounter water passing through KS pass-through hole 2. In this embodiment, KS deflector 4 is slightly elevated away from the backside of deflector head 1, and is connected thereto by KS shaft 3. A KS skirt 5 provides added support to KS shaft 3, and in combination with KS shaft 3 and KS deflector 4, defines KS exit orifice 6.

In operation, when the water supply is turned on, water enters sprinkler body 8 through water inlet 11, passes through the sprinkler body 8 and exits nozzle orifice 13 as a water jet. The jet is either completely or partially channeled into KS pass-through hole 2, which in its resting position is substantially aligned with nozzle orifice 13. Water enters KS pass-through hole 2 and passes through water deflecting pad 14 where it contacts KS deflector 4. KS deflector 4 directs the water jet away at an angle through exit orifice 6, thereby causing a propulsive force driving main deflector head 1 from its resting position. As deflector head 1 tilts from its resting position, water deflecting pad 14 is increasingly engaged by the jet of water exiting nozzle orifice 13 until the rotational propulsive force becomes large enough to drive deflector head 1 into a wobbling and spinning action. As water deflecting pad 14 is increasingly engaging the jet of water, the Kick-Starter becomes progressively disengaged from the water jet. Once deflecting pad 14 is at its maximum engagement with the water jet, the Kick-Starter becomes disengaged or partially disengaged from the jet of water, depending on the sprinkler head configuration. When the water supply is cut off, the Kick-Starter returns to its resting position with KS pass-through hole 2 substantially aligned with nozzle orifice 13.

Figure 6:
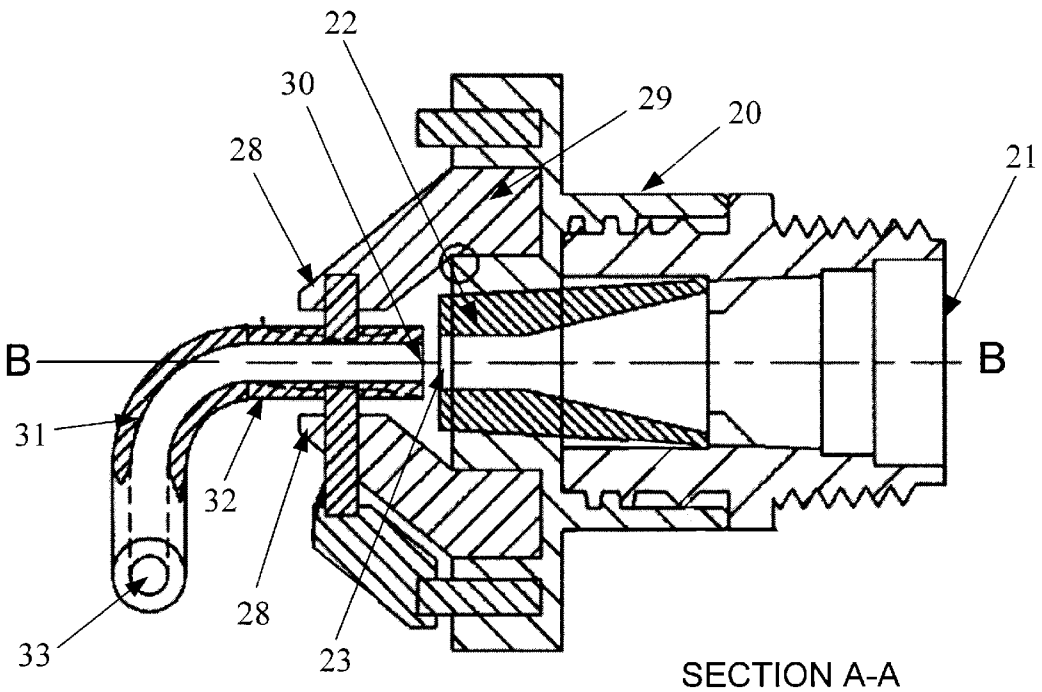
FIG. 6 is a cross-sectional view through axis A—A of the sprinkler head of FIGS. 3 and 5.
Figure 5:
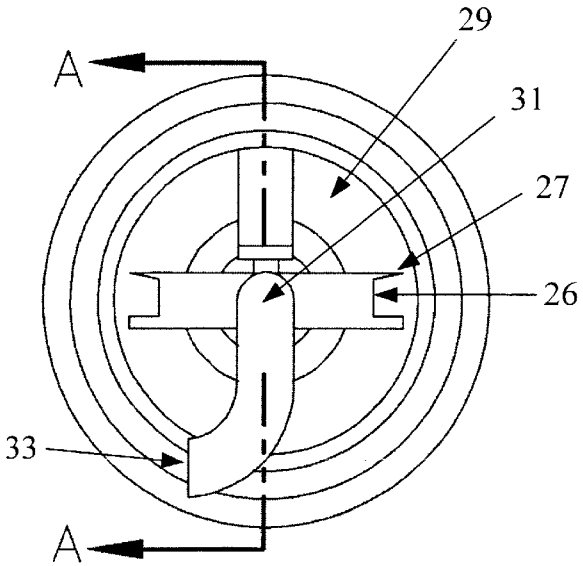
FIG. 5 is a top view of the sprinkler head of FIG. 3 depicting the Kick-Starter in its resting position.

An alternative embodiment of the Kick-Starter shown with a spinner type sprinkler head is depicted in FIGS. 3–6. Although slightly different in its configuration from the embodiment depicted in FIGS. 1 and 2, the Kick-Starter mechanism of this embodiment operates according to the same principles. Sprinkler body 20 has a water inlet 21 at one end and a nozzle 22 at the other. A nozzle orifice 23 is disposed within nozzle 22, and is in fluid connection with water inlet 21. Sprinkler body 20 has an attached main deflector head 24 having a water deflecting pad 25 attached thereto. The deflecting pad 25 has a plurality of deflector grooves 26 formed therein for deflecting water being directed thereagainst, with each of the grooves 26 on deflection pad 25 open at the peripheral edge portion 27 of deflecting pad 25. The deflecting pad is movably (preferably pivotally) held by a plurality of posts 28, which in this embodiment are in turn attached to a post support base portion 29 which is rotatably connected to sprinkler body 20 such that, in operation, post support base 29 will rotate about an axis B—B as depicted in FIG. 6. Water deflecting pad 25 has a KS pass-through hole 30 disposed generally centrally therein, such that in its resting position it is substantially aligned with nozzle orifice 23. A KS deflector 31 is affixed to the backside of main deflector head 24 behind water deflecting pad 25 in a position so as to encounter water passing through KS pass-through hole 30. In this embodiment, KS deflector 31 takes the form of a bend in a tube, the tube portion connecting KS deflector 31 to the backside of deflector head 24 being KS shaft 32. KS exit orifice 33 is in fluid connection with KS deflector 31. Although the Kick-Starter mechanism in this embodiment is depicted as a tube (KS shaft) and at least one bend (KS deflector), as is readily apparent to those skilled in the art a similar function could be accomplished by using an embodiment of the Kick-Starter mechanism similar to that depicted in FIGS. 1 and 2.

In operation, when the water supply is turned on, water enters sprinkler body 20 through water inlet 21, passes through the sprinkler body 20 and exits nozzle orifice 23 as a water jet. The jet is either completely or partially channeled into KS pass-through hole 30, which in its resting position is substantially aligned with nozzle orifice 23. Water enters KS pass-through hole 30 and passes through water deflecting pad 25 where it contacts KS deflector 31. KS deflector 31 directs the water jet away at an angle through KS exit orifice 33, thereby causing a propulsive force driving main deflector head 24 from its resting position. As deflector head 24 tilts from its resting position, water deflecting pad 25 is increasingly engaged by the jet of water exiting nozzle orifice 23 until the rotational propulsive force becomes large enough to drive deflector head 24 into a wobbling and spinning action. As water deflecting pad 25 is increasingly engaging the jet of water, the Kick-Starter becomes progressively disengaged from the water jet. Once deflecting pad 25 is at its maximum engagement with the water jet, the Kick-Starter becomes disengaged or partially disengaged from the jet of water, depending on the sprinkler head configuration. When the water supply is cut off, the Kick-Starter returns to its resting position with KS pass-through hole 30 substantially aligned with nozzle orifice 23.

Thus the subject invention provides a method of initiating sprinkler head motion comprising the steps of (a) providing a sprinkler head connected to a water supply, said sprinkler head comprising a sprinkler body with a water inlet disposed therein, a nozzle orifice in fluid connection with said water inlet, a water deflecting pad movably attached to said body, and a Kick-Starter mechanism, said Kick-Starter mechanism comprising a KS pass-through hole and a KS deflector in fluid connection with said pass-through hole, said Kick-Starter mechanism connected to said water deflecting pad in a configuration such that a water jet exiting said nozzle orifice will encounter said pass-through hole and contact said KS deflector pad, whereby the water is redirected at an angle causing a propulsive force that drives said water deflecting pad from its resting position and into increasing engagement with the water jet, whereby said pass-through hole is progressively disengaged from the water jet; and (b) turning on the water supply, whereby water enters said water inlet and exits said nozzle orifice as a water jet which encounters said pass-through hole and contacts said KS deflector, whereby the water is redirected at an angle causing a propulsive force that drives said water deflecting pad from its resting position and into increasing engagement with the water jet, whereby said KS pass-through hole is progressively disengaged from the water jet; whereby motion of said sprinkler head is initiated. Once the water supply is cut off, the water deflection pad and KS mechanism return to their resting positions.

As will be apparent to those skilled in the art in view of this disclosure, the Kick-Start technology can be advantageously used with many sprinkler designs known in the art, whether extending downward from below a water supply or mounted upright atop a water supply. The subject invention permits wobbling or spinning to begin once a water supply is turned on to produce a stream of water, and prevents sprinkler head stalling upon start-up.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A sprinkler head comprising a sprinkler body with a water inlet disposed therein; a nozzle orifice in fluid communication with said water inlet; and a deflector head, said deflector head comprising a water deflecting pad and a kick-start mechanism, said deflector head movably attached to said sprinkler body, said kick-start mechanism comprising a pass-through hole and a kick-start deflector in fluid connection with said pass-through hole, said kick-start mechanism connected to said water deflecting pad in a configuration such that a water jet exiting said nozzle orifice will encounter said pass-through hole and contact said kick-start deflector, whereby the water is redirected at an angle causing a propulsive force that drives said water deflecting pad from its resting position and into moving engagement with said water jet, whereby said pass-through hole is progressively disengaged from the water jet.

2. The sprinkler head according to claim 1, wherein said kick-start mechanism is centrally located on said water deflecting pad, such that said pass-through hole is substantially aligned with said nozzle orifice in its resting position.

3. The sprinkler head according to claim 2, wherein said kick-start deflector is affixed to a backside of said deflector head.

4. The sprinkler head according to claim 3, wherein said kick-start mechanism further comprises a kick-start shaft interposed between said pass-through hole and said kick-start deflector.

5. The sprinkler head according to claim 3, wherein said kick-start deflector is a bent tube.

6. The sprinkler head according to claim 1, wherein said water deflecting pad comprises a plurality of deflection grooves, wherein said deflection grooves are open along a peripheral edge of said water deflecting pad.

7. The sprinkler head according to claim 6, where said deflection grooves are configured to rotate said water deflecting pad when said water jet encounters said deflection grooves.

8. The sprinkler head according to claim 1, wherein said water deflecting pad is connected to a support base by a plurality of posts, wherein said support base is movable attached to said sprinkler body.

9. The sprinkler head according to claim 8, wherein said water deflecting pad is connected to said support base by three posts.

10. The sprinkler head according to claim 8, wherein said water deflecting pad is connected to said support base by two posts.

11. The sprinkler head according to claim 10, wherein said water deflecting pad is pivotally connected said posts.

12. A method of initiating sprinkler head motion comprising the steps of:

a) providing a sprinkler head connected to a water supply, said sprinkler head comprising a sprinkler body with a water inlet disposed therein; a nozzle orifice in fluid communication with said water inlet; and a deflector head, said deflector head comprising a water deflecting pad and a kick start mechanism, said deflector head movably attached to said sprinkler body, said kick-start mechanism comprising a pass-through hole and a kick-start deflector in fluid connection with said pass-through hole, said kick-star mechanism connected to said water deflecting pad in a configuration such that a water jet exiting said nozzle orifice will encounter said pass-through hole and contact said kick-start deflector, where the water is redirected at an angle causing a propulsive force that drives said water deflecting pad from its resting position and into moving engagement with said water jet, whereby said pass-through hole is progressively disengaged from the water jet; and b) turning on the water supply, whereby water enters said water inlet and exits said nozzle orifice as a water jet which encounters said kick-start mechanism, whereby motion of said sprinkler head is initiated.

13. The method according to claim 12, wherein said kick-start mechanism is centrally located on said water deflecting pad, such that said pass-through hole is substantially aligned with said nozzle orifice in its resting position.

14. The method according to claim 13, wherein said kick-start deflector is affixed to a backside of said deflector head.

15. The method according to claim 14, wherein said kick-start mechanism further comprises a kick-start shaft interposed between said pass-through hole and said kick-start deflector.

16. The method according to claim 14, wherein said kick-start deflector is a bent tube.

17. The method according to claim 12, wherein said water deflecting pad comprises a plurality of deflection grooves, wherein said deflection grooves are open along a peripheral edge of said water deflecting pad.

18. The method according to claim 17, where said deflection grooves are configured to rotate said water deflecting pad when said water jet encounters said deflection grooves.

19. The method according to claim 12, wherein said water deflecting pad is connected to a support base by a plurality of posts, wherein said support base is movable attached to said sprinkler body.

20. The method according to claim 19, wherein said water deflecting pad is connected to said support base by three posts.

21. The method according to claim 19, wherein said water deflecting pad is connected to said support base by two posts.

22. The method according to claim 21, wherein said water deflecting pad is pivotally connected said posts.

* * * * *